US005769694A

United States Patent [19]

Hesse et al.

[11] Patent Number: 5,769,694

[45] Date of Patent: Jun. 23, 1998

[54] APPARTUS FOR THE SURFACE MACHINING OF WORKPIECES

[75] Inventors: Werner Hesse; Hans-Peter Boller, both of Fockbek, Germany

[73] Assignee: Werkzeugmaschinen GmbH, Rendsburg, Germany

[21] Appl. No.: 763,199

[22] Filed: Dec. 10, 1996

[30] Foreign Application Priority Data

Dec. 15, 1995 [DE] Germany ..... 195 47 086.9

[51] Int. Cl.[6] ..... B24B 5/00; B24B 29/00

[52] U.S. Cl. ..... 451/269; 451/268

[58] Field of Search ..... 451/262, 268, 451/269, 284, 288, 285, 41, 259, 177, 106, 210, 82; 110/158, 261, 302

[56] References Cited

U.S. PATENT DOCUMENTS 4,315,383 2/1982 Day .

*Primary Examiner*—Timothy V. Eley
*Assistant Examiner*—Derris H. Banks
*Attorney, Agent, or Firm*—Vidas, Arrett & Steinkraus P.A.

[57] ABSTRACT

An apparatus for the surface machining of the workpieces by grinding, polishing, lapping or the like, comprising a frame, a lower and an upper working wheel supported by the frame, at least one thereof being rotatably driven by driving means, at least one runner wheel between the working wheels, that runner wheel having apertures for the accommodation of the workpieces and having further teeth at the circumference thereof, an inner and an outer ring radially outwardly and radially inwardly of the working wheels, respectively, adapted to accommodate a row of circularly arranged pins, at least the outer pin ring being rotatably supported by the frame and driving by second driving means, the runner wheel camming with the outer and the inner row of pins, the improvement being characterized by the pin ring being rotatably supported by an outer annular bearing ring stationarily supported by the frame through a plurality of circumferentially spaced rollers, the rollers being rotatably supported by the bearing ring about a stationary axis, the cross section of the circumference of the rollers being conically shaped and the pin ring having a circumferential groove conical in cross section and cooperating with the circumference of the rollers.

11 Claims, 6 Drawing Sheets

APPARTUS FOR THE SURFACE MACHINING OF WORKPIECES

The invention refers to an apparatus for the surface machining of workpieces by grinding, polishing, lapping or the like.

Honing, lapping, polishing or grinding machines are known wherein the tools are defined by two working wheels having opposed parallel working or machining surfaces, one of the wheels being rotatably driven by a suitable driving means. Running wheels are located between the working wheels and form workpiece holders by apertures formed therein and accommodating the workpieces. The circumference of the runner wheels have a toothing to engage a pin ring or wheel on the outer and inner side of the working wheels so that the runner wheels are moved and rotated forwardly between the pin rings if one of the pin rings is rotatably driven. The workpieces are subject to a cycloidial movement which is superimposed by the rotation of the working wheels. Thus, a precise machining of plane parallel surfaces is achieved. For this reason such machines for example are used to machine so-called wafers for the manufacture of semiconductor chips.

The runner wheels engage only a portion of the pins over their vertical length whereby the pins are subject to stresses in a restricted area. This stress is increased in that a slipping effect takes place between the toothing of the runner wheels and the pins. This phenomenon leads to a wear of the pin after a certain time which affects the precise movement of the runner wheels and the precise machining of the workpieces.

In order to increase the number of workpieces which can be contemporarily machined in the machine it is usual to increase the diameter of the working wheels. However, this causes problems with respect to the movement of the runner wheels.

With the invention an apparatus for the surface machining is to be provided wherein the driven or rotated outer pin ring is precisely supported for the feed of the runner wheels.

In the invention the pin ring is rotatably supported by an annular bearing ring which encircles the pin ring. The bearing ring is stationarily supported by the frame, and the pin ring is supported by the bearing ring through a plurality of circumferentially spaced cylindrical rollers. The rollers engage a groove on the circumference of the pin ring complementarily formed.

In order to change the position of the pin ring the bearing rollers can be adjusted axially, i.e. vertically and/or radially by suitable means. As to this the rollers can be supported by a pin which in turn is accommodated by an eccentric sleeve. The pin is axially displaceable in the sleeve, and the sleeve is rotatably supported.

In it also possible to provide a support of the pin ring for vertical adjustment and to provide lifting means for such adjustment.

In order to reduce the wear of the pins sleeves can be provided which are rotatably supported on the pins so that the toothing of the runner wheels engages the sleeves. By such a design for the pin rings no frictional engagement occurs between the toothing of the runner wheel and the pins, rather the toothing engages the sleeves. Since the sleeves engage the associated pin over a greater length the surface load and thus the possible wear is remarkably reduced. A wear of the sleeves is not critical as the sleeves can be simply replaced. A replacement of pins as known in connection with usual machines is relatively time consuming.

In the apparatus according to the invention means are additionally provided by which the sleeves can be held on the pins. Such an annular means can be defined by a radial flange overlapping the sleeves at least partially. Preferably, the flange is formed of plastic material.

In order to prevent contaminations from penetrating between sleeve and pin which normally increase the friction, the sleeves are preferably closed at their upper ends. Additionally, the sleeves can be provided with an radially outwardly extending flange at the lower end which is supported by the pin ring. Usually, the pins are located in the ring by an interference.

As mentioned, the pin ring can be raised or lowered by lifting means in order to lower the outer pin row as far as a displacement of the runner wheels on the lower working wheel for loading or unloading purposes can be carried out. This is relatively advantageous where the workpieces tend to stick to the lower working wheel so that a lifting for unloading purposes meets problems. This takes place above all in cases where a liquid or a fluid able to flow is used as working agent.

An embodiment example of the invention is subsequently described along the accompanying drawings.

Figure 1:
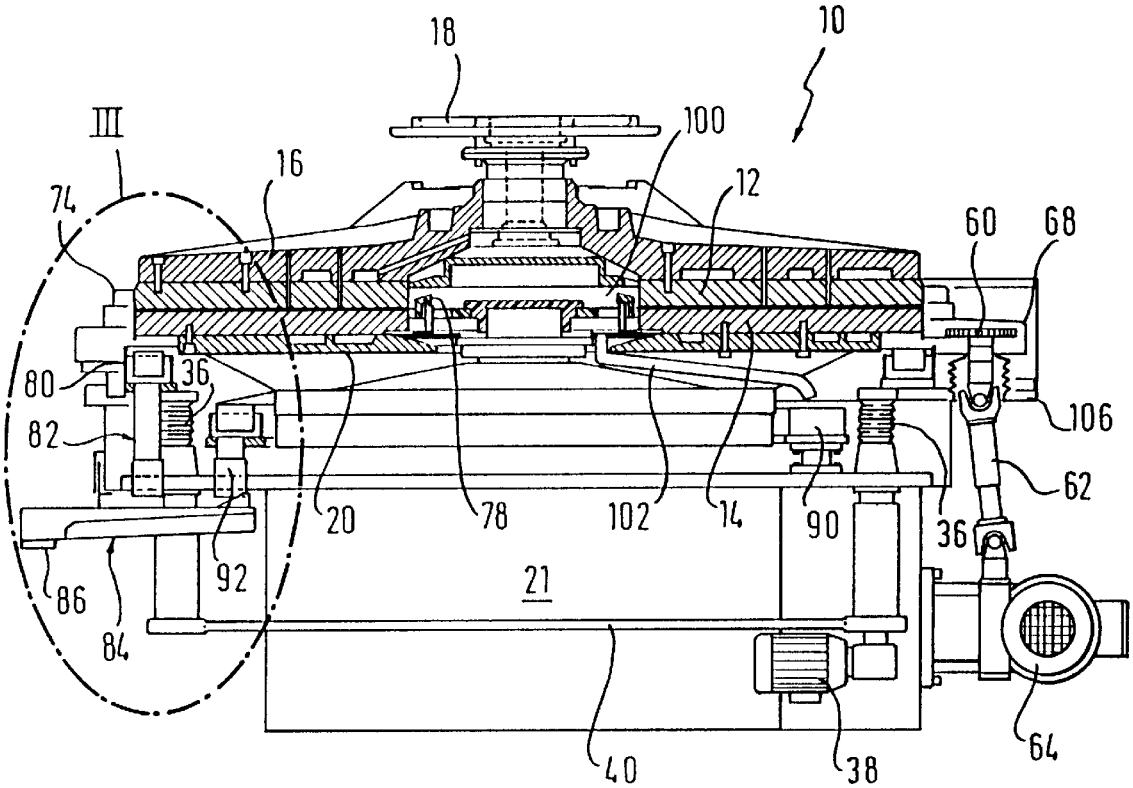
FIG. 1 shows diagrammatically an apparatus according to the invention.

FIG. 1 illustrates a polishing apparatus 10 having an upper working wheel 12 and a lower working wheel 14. The upper working wheel 12 is threaded to a retaining plate 16 which has a flange 18 at the upper side for a connection with a device for lifting and pivoting of the working wheel 12 relative to the lower working wheel 14. The lower working wheel 14 is connected with a retaining plate 20 which in turn is threaded to a frame 21. The working wheels 12, 14 are rotatably driven by a suitable driving means (not shown) in a conventional manner.

Figure 2:
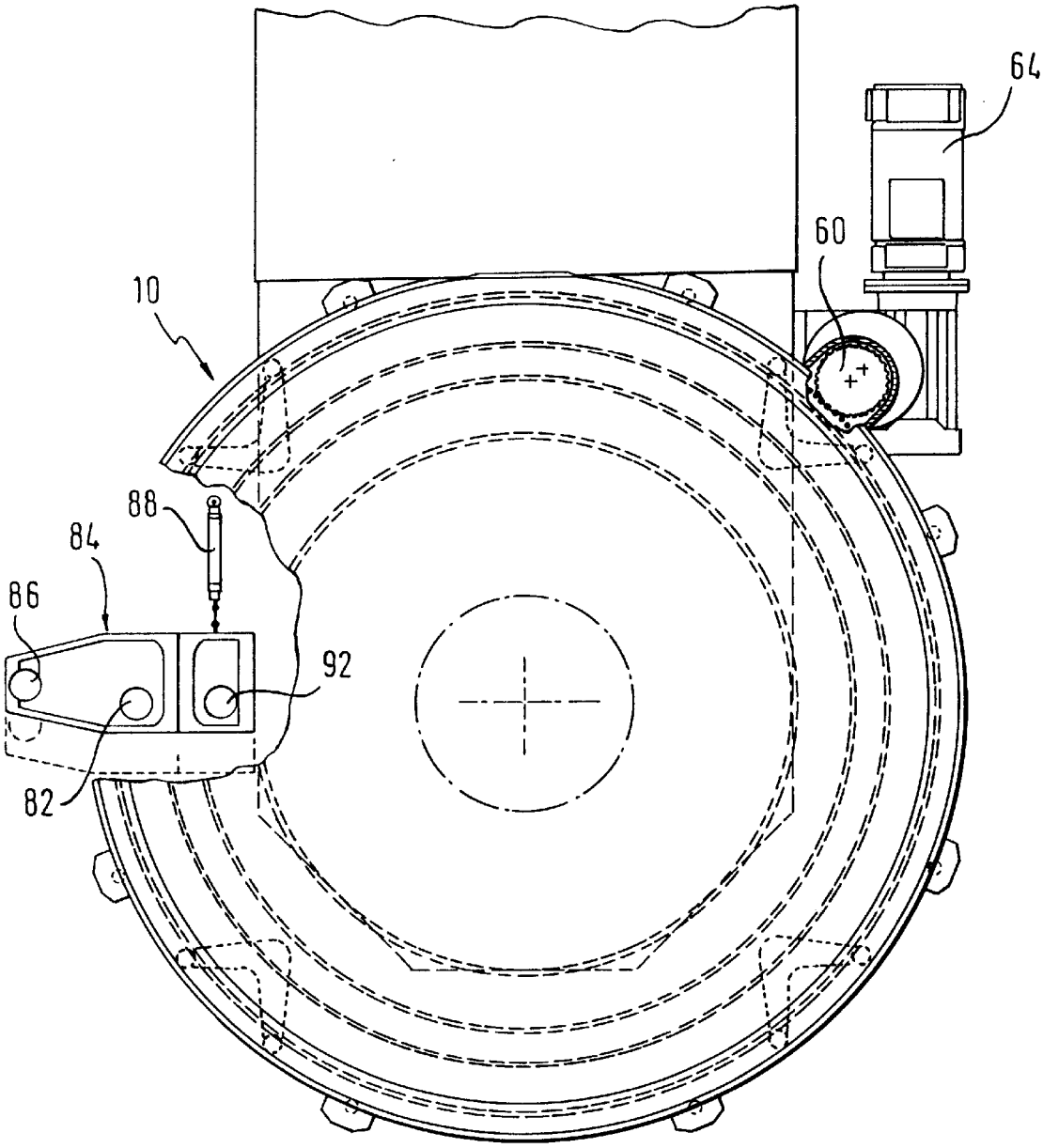
FIG. 2 shows a plan view of the apparatus of FIG. 1 including partial broken away areas.
Figure 3:
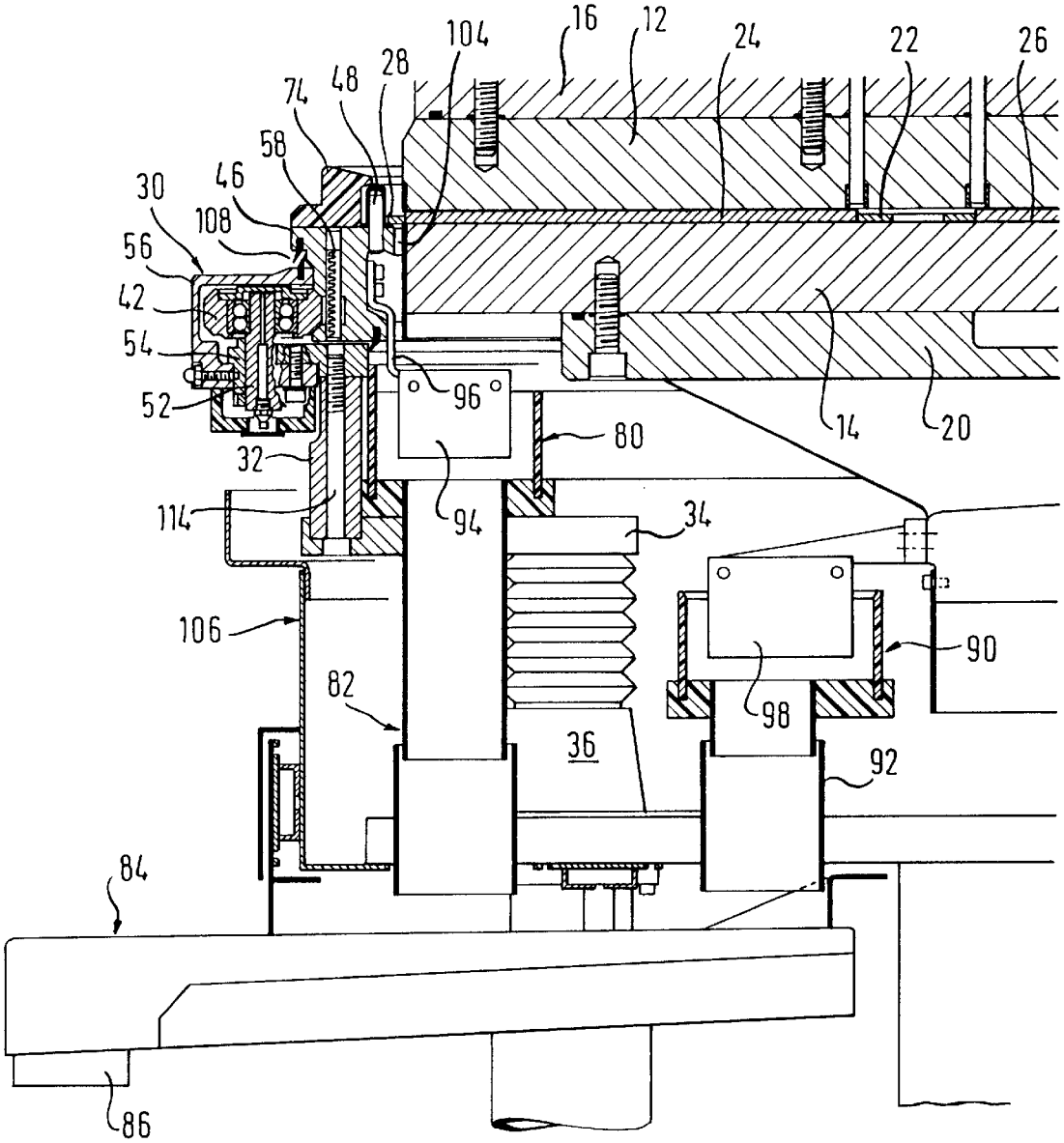
FIG. 3 shows in a larger scale the left portion of the apparatus of FIG. 1.
Figure 4:
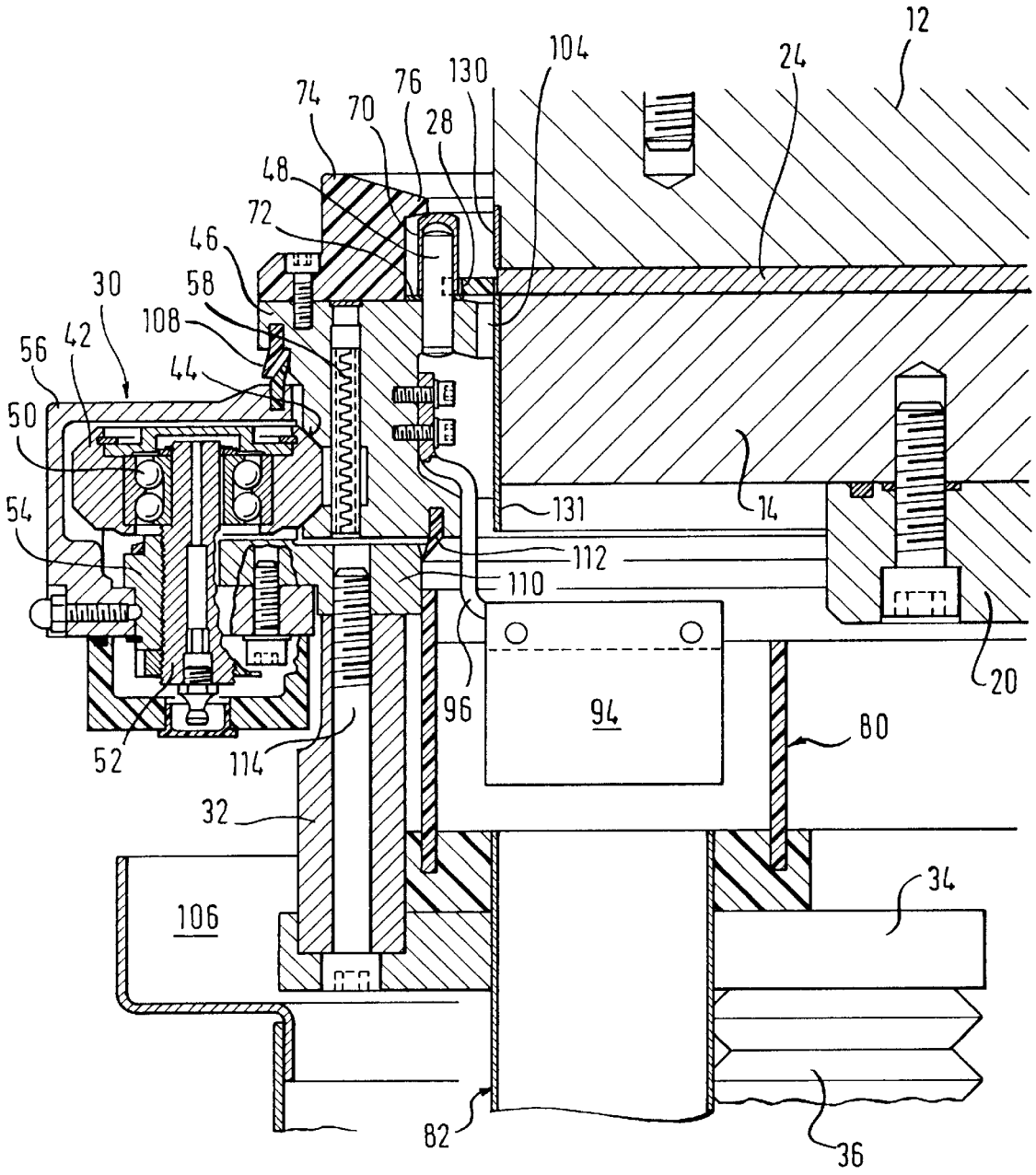
FIG. 4 shows in a larger scale the portion of FIG. 3.

In FIGS. 3 and 4 a runner wheel 22 can be seen located between the working wheels 12 and 14. The runner wheel has circular apertures for the accommodation of circular workpieces 24 or 26, respectively. The runner wheel 22 have a toothing 28 at the circumference thereof. An annular hearing member 30 is supported by plate 34 through a support portion 32. Plate 34 is supported by a lifting means 36 mounted on the frame 21. In FIG. 2 a second lifting means 36 is indicated. This lifting means is actuated by a motor 38, with a shaft 40 interconnecting tooth lifting devices 36. As can be seen in FIG. 4 a plurality of cylindrical rollers 42 with beveled upper and lower edges are supported by the annular bearing member 30. The rollers engage a beveled groove 44 at the periphery of a pin ring 46, the ring 46 being provided with a plurality of pins of an outer row of pins. The pins are mounted in corresponding bores as shown at 48 in FIGS. 3 and 4 and fastened by an interference fit. The bearing of the rollers 42 takes place by a roller bearing 50 which is located on a bearing pin 52 having a free end sitting in a threaded sleeve 54 which in turn is rotatably supported by bearing ring 56. A rotation of pins 52 thus leads to an axial or vertical displacement of rollers 42, and a rotation of sleeve 54 results in a radial displacement thereof because sleeve 54 is eccentric. Thus, the relative position of pin ring 46 can be changed relative to bearing member 30.

Figure 5:
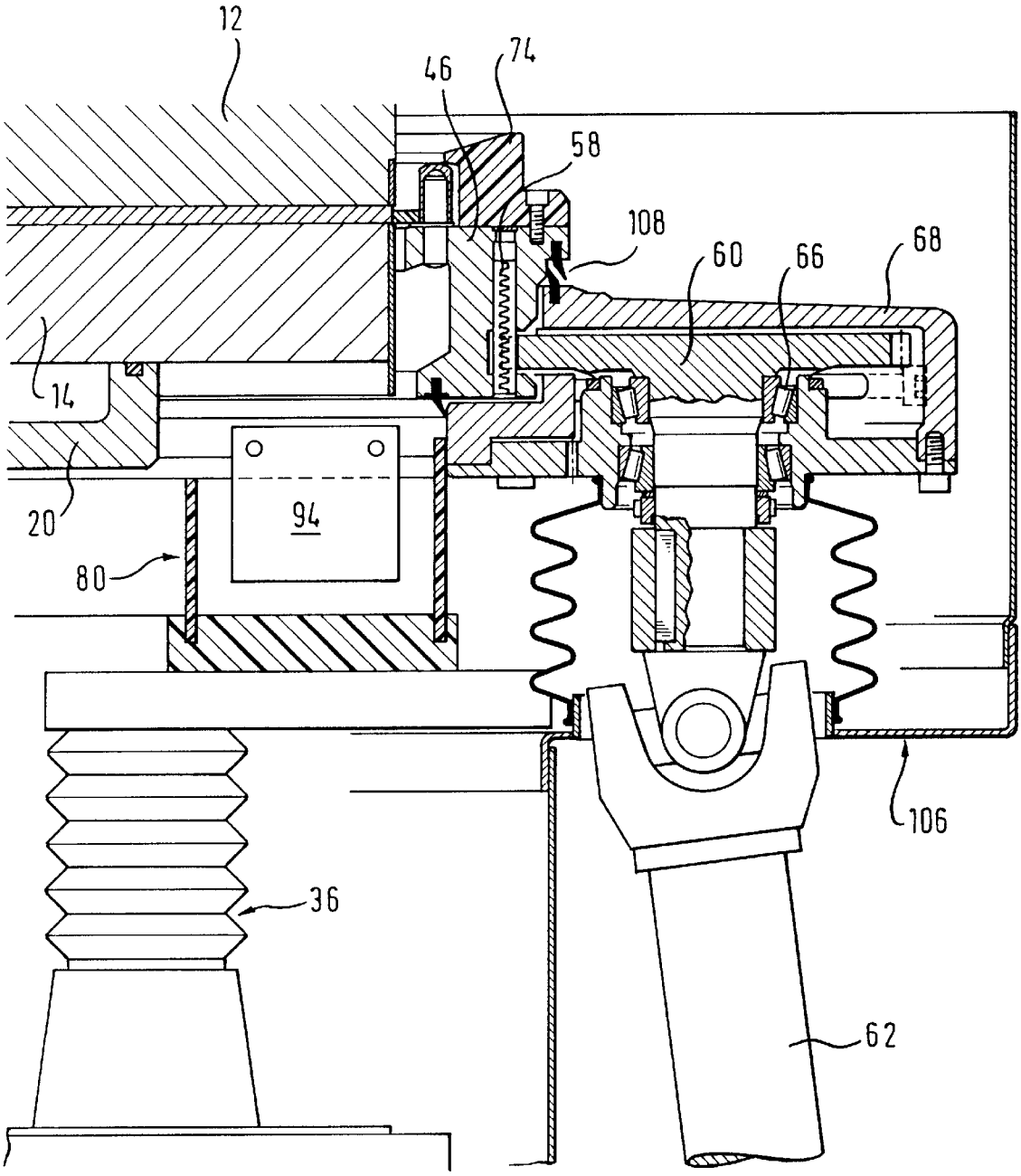
FIG. 5 shows in a larger scale the right portion of the apparatus of FIG. 1.
Figure 6:
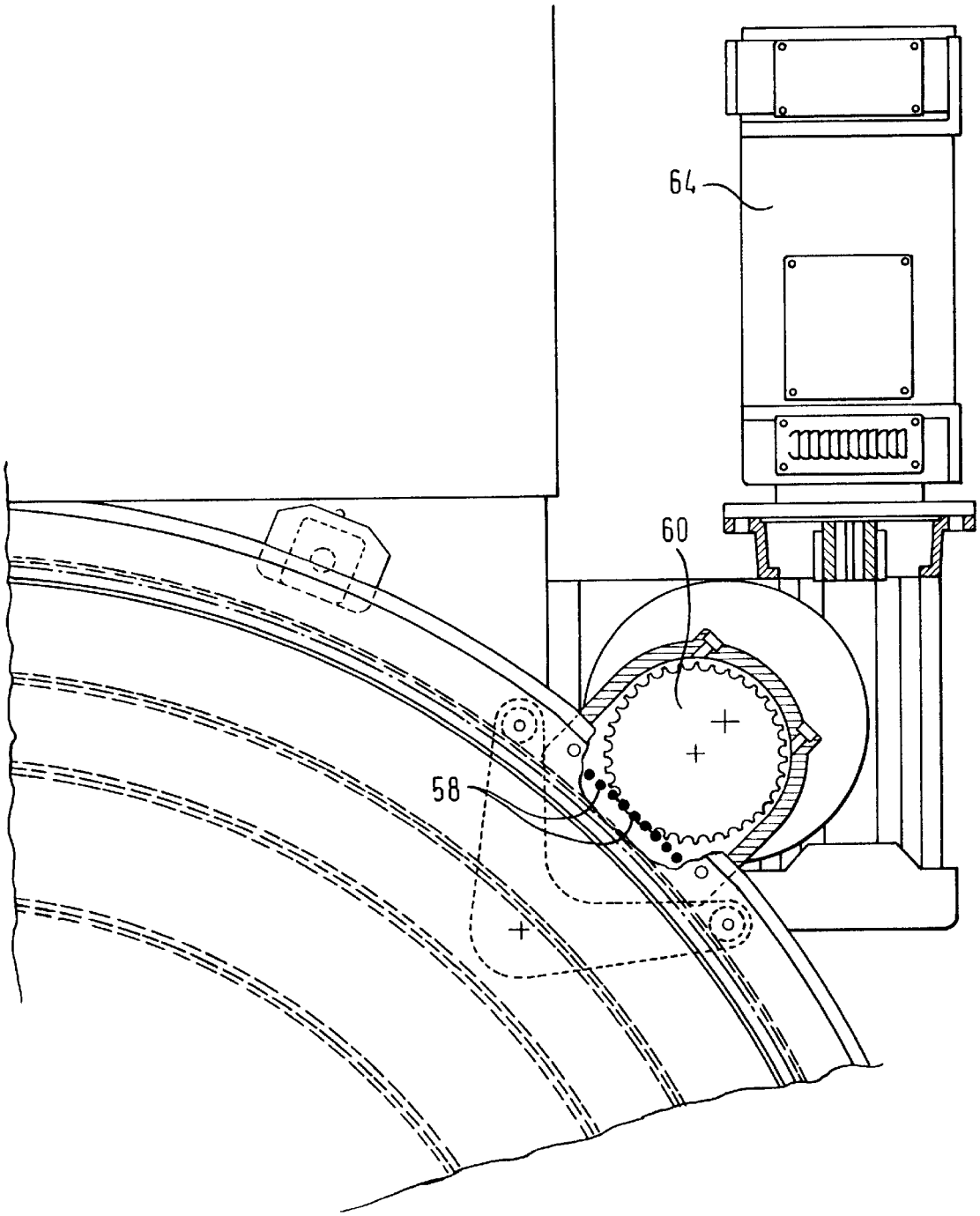
FIG. 6 shows in a larger scale a portion of the illustration of FIG. 2.

Dowel pins 58 are accommodated by the pin ring 46 in equally circumferentially spaced relationship. The dowel pins extend transverse to groove 44. As can be seen in FIGS. 2 and 5 a pinion 60 engages the dowel pins 58. The pinion 60 is driven by a gear motor 64 through a universal joint shaft 62 whereby the pin ring with the pins is rotated. The universal joint shaft 62 is telescopic so that this driving connection is independent from the level of pin ring 46 which, as mentioned, can be raised or lowered by lifting means 36. The pinion 60 is rotatably supported in a housing 68 by means of a roller bearing.

As can be particularly seen in FIG. 4 a sleeve 70 is placed on each pin of the pin ring from above, the upper end of sleeve 70 being closed while the lower end is supported by the pin ring through a washer 72 of polyamide. As can be seen, the toothing 28 of the runner wheel 22 engages the outer circumference of the sleeve. A ring 74 of plastic material is threaded to the upper side of pin ring 46 and provides an upper radially inwardly extending flange 76 which partially extends over the sleeves 70 and thus prevents the sleeve from being lifted or removed. An inner row of pins is accommodated by a ring 78 which is fixedly secured to the lower plate 20, and a ring 74 of plastic material extends above the inner pins.

An annularly extending channel 80 is located on a plate 34, the channel being in communication with the upper side of a gate 84 through a telescopic conduit 82. Gate 84 is shown in FIG. 2 in a plan view. It can be displaced a limited amount by a cylinder 88 as shown by dotted lines. The outlet 86 of gate 84 can be selectively aligned with a desired drain. As can be seen in FIG. 2 a further annularly extending channel 90 adapted to be raised or lowered by a suitable lifting means can be aligned with gate 84 through a telescopic tube 92. A wiper blade 94 is fixed to the inner side of pin ring 46 through an arm 96. Upon rotation of pin ring 46 blade 94 moves in channel 80 and conveys liquid in the channel towards the telescopic tube 82 and thus to gate 84. A further blade 98 is located in the annular channel 90 and is also rotatably driven in order to move liquid into the telescopic tube 92 and thus to gate 84.

Particularly with a polishing process for workpieces 24 a relatively large amount of polishing or rinsing liquid is necessary. The liquid either exits at the outer side between the working wheels 12, 14 or at the inner side in the hollow space 100 between the working wheels (FIG. 1). From the hollow space 100 the liquid flows through a stationary tube 102 into the inner channel 90. Outwardly exiting liquid is prevented by a ring 74 from flowing more outwardly, rather flows downwards through passages or channels 104 between pin ring 46 and lower working wheel 14 into channel 80. It can be seen that nearly the total working fluid is collected in channels 80 and 90 and led to a recycling tank (not shown) or to a drainage system, respectively, in correspondence with the position of gate 84. The complete arrangement shown is additionally encircled by a tank 106 wherein the fluid not collected by the channels 80 and 90 is collected. A thin jacket 130 or 131, respectively, is located on the circumference of the working wheels which consists of hard corrosion resistent material and therefore, is not attacked by the working fluid. Jacket 131 extends upwardly beyond wheel 14 and serves for the deflection of a fluid towards channel 80.

A lip sealing 108 is located between the annular bearing member 30 or the bearing ring 56, respectively, and the pin ring 46 in order to prevent penetration of contamination or the discharge of liquid. A further lip sealing is located between the lower side of pin ring 46 and a ring 110. The sealing is designated with 112. Ring 110 is connected to the support member 32 through dowel pins 114 and in turn retains bearing ring 56.

As can be seen, the complete working fluid is collected and can be processed and re-used. It can be further seen that by means of the lifting devices 36 the pin ring 46 and thus the pins can be lowered as much as necessary that the runner wheels 22 can be simply displaced on the lower working wheel or unloaded by sliding them away from the upper surface of the lower working wheel.

We claim:

1. An apparatus for the surface machining of the workpieces by grinding, polishing, lapping or the like, comprising a frame, a lower and upper working wheel supported by the frame, at least one thereof being rotatably driven by driving means, at least one runner wheel between said working wheels, that runner wheel having apertures for the accommodation of said workpieces and having further teeth at the circumference thereof, an inner and an outer ring radially outwardly and radially inwardly of said working wheels, respectively, adapted to accommodate a row of circularly arranged pins, at least the outer pin ring being rotatably supported by said frame and driven by second driving means, said runner wheel camming with said outer and said inner row of pins, the improvement being characterized by the pin ring being rotatably supported by an outer annular bearing ring stationarily supported by said frame through a plurality of circumferentially spaced cylindrical rollers with beveled upper and lower edges, the rollers being rotatably supported by said bearing ring about a stationary axis, and said pin ring having a beveled groove extending at its circumference to cooperate with the circumference of said rollers.

2. The apparatus of claim 1, wherein said rollers are supported by said bearing ring for vertical and/or radial adjustment.

3. The apparatus of claim 2, wherein said rollers are supported by a pin which is accommodated by an eccentric sleeve for vertical adjustment, and said sleeve is rotatably supported.

4. The apparatus of claim 3, wherein a lip sealing is located between said bearing ring and said pin ring.

5. The apparatus of claim 2, wherein a lip sealing is located between said bearing ring and said pin ring.

6. The apparatus of claim 1, wherein said pin ring is vertically displaceably supported and can be raised or lowered by lifting means.

7. The apparatus of claim 1, wherein sleeves are rotatably supported by said pins, and a ring is releasably attached to said pin ring and encircles said circular row of pins, said ring including a radial flange which extends at least partially above said pins so that said sleeve are prevented from being removed from said pins.

8. The apparatus of claim 7, wherein said sleeves are closed at the upper ends.

9. The apparatus of claim 8, wherein sad pins are accommodated in bores of said pin ring, and said sleeves are supported on said pin rings through a plastic washer.

10. The apparatus of claim 7, wherein said pins are accommodated in bores of said pin ring, and said sleeves are supported on said pin rings through a plastic washer.

11. The apparatus of claim 7, wherein said ring is of plastic material.

* * * * *

UNITED STATES PATENT AND TRADEMARK OFFICE

CERTIFICATE OF CORRECTION

PATENT NO. : 5,769,694

DATED : June 23, 1998

INVENTOR(S) : Werner Hesse et al.

It is certified that error appears in the above-identified patent and that said Letters Patent is hereby corrected as shown below:

On the title page, Item [54] and Col. 1, line 1:

In the title of the patent on the title page, delete "APPARTUS" and insert -- APPARATUS --.

Col. 1, line 1, delete "APPARTUS" and insert -- APPARATUS --

Signed and Sealed this

First Day of September, 1998

*Attest:*

*Attesting Officer*

Bruce Lehman

BRUCE LEHMAN

*Commissioner of Patents and Trademarks*